US005881803A

United States Patent [19]

Liu et al.

[11] Patent Number: 5,881,803

[45] Date of Patent: Mar. 16, 1999

[54] HEAT EXCHANGER CONSTRUCTION

[75] Inventors: Johnny Jiayan Liu, Alta Loma; Gary Johnson, Santa Clarita, both of Calif.

[73] Assignee: THMX Holdings, LLC, Ontario, Calif.

[21] Appl. No.: 805,980

[22] Filed: Feb. 25, 1997

[51] Int. Cl.[6] ..... F28D 1/047

[52] U.S. Cl. ..... 165/153; 165/152; 165/173; 165/175; 165/178; 138/115; 138/116; 285/122.1

[58] Field of Search ..... 165/151, 152, 165/153, 173, 175, 178; 138/117, 115, 116; 285/122.1, 188

[56] References Cited

U.S. PATENT DOCUMENTS

| | | | |
|---|---|---|---|
| 2,792,201 | 5/1957 | Whistler, Jr. | 165/152 X |
| 3,702,632 | 11/1972 | Grimshaw | 165/152 |
| 4,903,763 | 2/1990 | Laveran et al. | 165/175 |
| 5,227,585 | 7/1993 | Zen | 138/117 X |

FOREIGN PATENT DOCUMENTS

| | | | |
|---|---|---|---|
| 374895 | 6/1990 | European Pat. Off. | 165/150 |
| 48-96986 | 6/1983 | Japan | 165/152 |
| 548994 | 11/1992 | United Kingdom | 165/151 |

*Primary Examiner*—Leonard R. Leo
*Attorney, Agent, or Firm*—Jones, Day, Reavis & Pogue

[57] ABSTRACT

A heat exchanger comprises a pair of spaced fittings each having a first opening on one side thereof for communication with a fluid carrying conduit. The fittings are connected to one another by at least one pair of tubes extending from second sides of the fittings in fluid communication with the first openings. The tubes diverge away from one another as they extend from the fittings and may be provided with heat dissipating fins. The tubes are preferably semi-circular in cross-section and in one form of the heat exchanger the tube ends are received by round openings in the fitting. By this construction, the use of header tanks and their associated disadvantages is avoided and a heat exchanger is provided which can withstand high internal pressures and is readily manufactured in a cost effective manner.

4 Claims, 6 Drawing Sheets

HEAT EXCHANGER CONSTRUCTION

BACKGROUND OF THE INVENTION

1. Field of the Invention

The present invention relates generally to heat exchanger construction and, more particularly, to the construction of a heat exchanger which eliminates the need for headers and thus is not only strong and lightweight but also achieves manufacturing efficiencies in its assembly.

2. Description of the Prior Art

Heat exchangers of various constructions are in widespread use, for example, in the automotive industry for use as automobile engine coolers, in climate control systems, as transmission and power steering oil coolers and the like. A typical heat exchanger construction for such applications comprises a pair of tanks, or headers, with finned tubes extending between the tanks. The tubes are usually formed flat so that fins may be attached to them as by brazing or other joining process. The flat tubes are inserted into slots formed in the tanks and are brazed in a furnace or welded in place. These tubes must fit tightly into the slots of the tanks or the joints formed therebetween may leak. An example of such construction is disclosed in U.S. Pat. No. 5,125,454 issued to Creamer et al.

The tanks themselves may be made from one-piece round pipe, or of sheet metal suitably stamped and formed. Generally, for round tanks, the maximum stress that the tank will perform under is represented by the expression Pd/2t, where d is the diameter of the tank, t is the thickness of the tank material and P is the maximum internal pressure of the tank. If the desired internal pressure of the tank if fixed, a heat exchanger with a large diameter tank can only withstand or operate at a lower pressure than a heat exchanger with a smaller diameter tank. Thus, in most cases the tank's material and diameter limit the heat exchanger's operating service pressure which in some applications requires the tank to be relatively heavy in construction.

Another disadvantage of heat exchangers which use header tanks is that the tank forming process typically involves stamping in the presence of an oil lubricant. Also, metal chips may be formed in the stamping process. As a result, the stamping requires a cleaning process to remove oil and metal chips from the tank after it has been formed. This increases costs of manufacture and as a result of the use of oils and cleaning solutions can also create environmental issues. Chips which are not removed from the tanks can contaminate the cooling system of the associated machinery and cause damage.

Accordingly, it is desirable to provide a heat exchanger which is constructed without the use of header tanks whereby oil and metal chip contaminants need not be removed in a separate cleaning process. It is further desirable to provide a heat exchanger which is capable of withstanding greater internal pressure, albeit with lightweight construction, by avoiding the use of header tanks. Still further it is desirable to provide a heat exchanger which avoids precise manufacturing processes as is necessary with known constructions using header tanks to ensure that the heat exchanger does not experience joint failure in use.

SUMMARY OF THE INVENTION

The present invention overcomes the disadvantages of the prior art by providing a heat exchanger comprising a pair of spaced fittings each having a first opening on one side thereof for communication with a fluid carrying conduit. The fittings are connected to one another by at least one pair of tubes extending from second sides of the fittings in fluid communication with the first openings. The tubes diverge away from one another as they extend from the fittings and may be provided with heat dissipating fins. The tubes are preferably semi-circular in cross-section and in one form of the heat exchanger the tube ends are received by round openings in the fitting. By this construction, the use of header tanks and their associated disadvantages is avoided and a heat exchanger is provided which can withstand high internal pressures and is readily manufactured in a cost effective manner.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
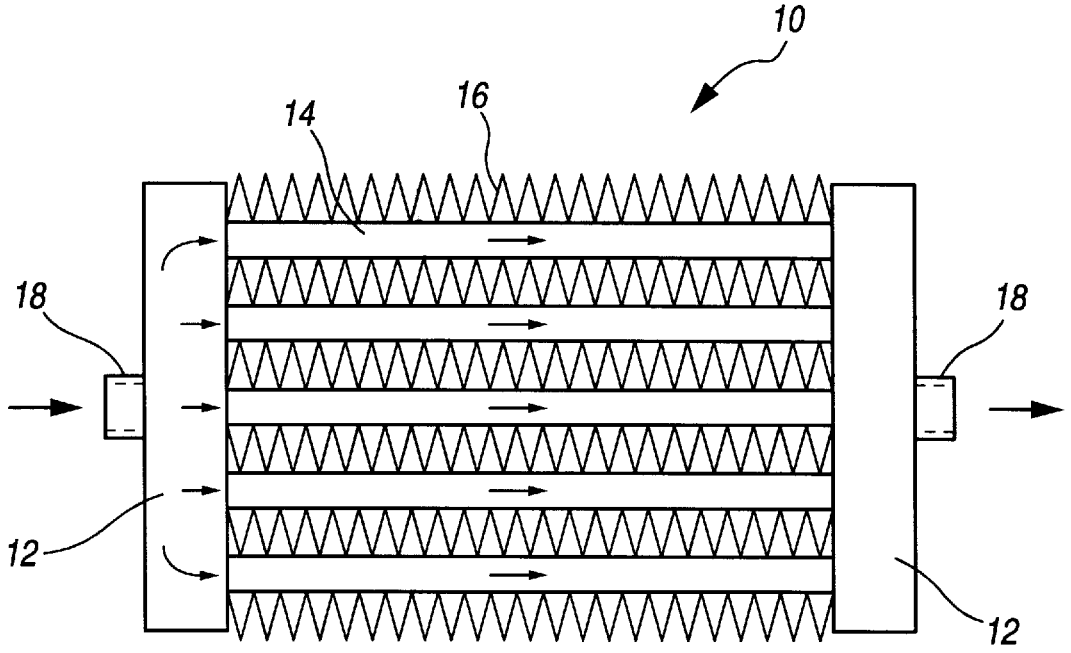
FIG. 1 (PRIOR ART)
FIG. 1 is a side view of a prior art heat exchanger which is constructed using conventional header tanks.
Figure 2:
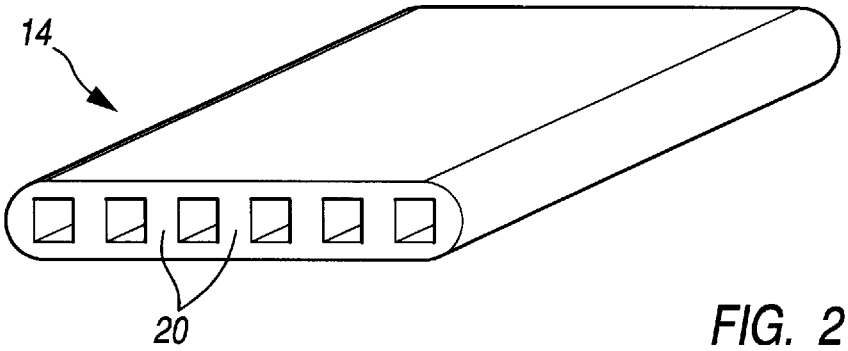
FIG. 2 (PRIOR ART)
FIG. 2 is a partial end view of a flat tube used in the heat exchanger of FIG. 1.

Referring now to the drawings and initially to FIG. 1, a prior art heat exchanger is designated generally by the reference number 10. The heat exchanger 10 includes as its principal components a pair of spaced header tanks 12 connected by tubes 14 to which heat dissipating fins 16 have been attached as by brazing or welding. Suitable inlet and outlet fittings 18 are attached to the tanks 12 such that a fluid to be cooled is conveyed into a first tank 12 then through the finned tubes 14 and into the opposite tank 12 where it is collected and expelled. FIG. 2 illustrates the construction of a typical tube 14 as used in the prior art heat exchanger 10. It is noted that the tube 14 is generally flat in construction and may have internal walls 20 for enhanced heat transfer and tube rigidity.

Figure 4:
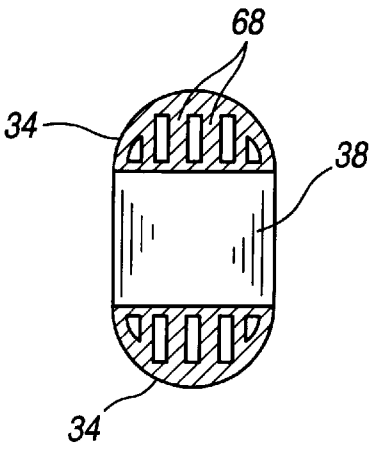
FIG. 4 is a cross-sectional view taken substantially along the line 4—4 of FIG. 3.
Figure 3:
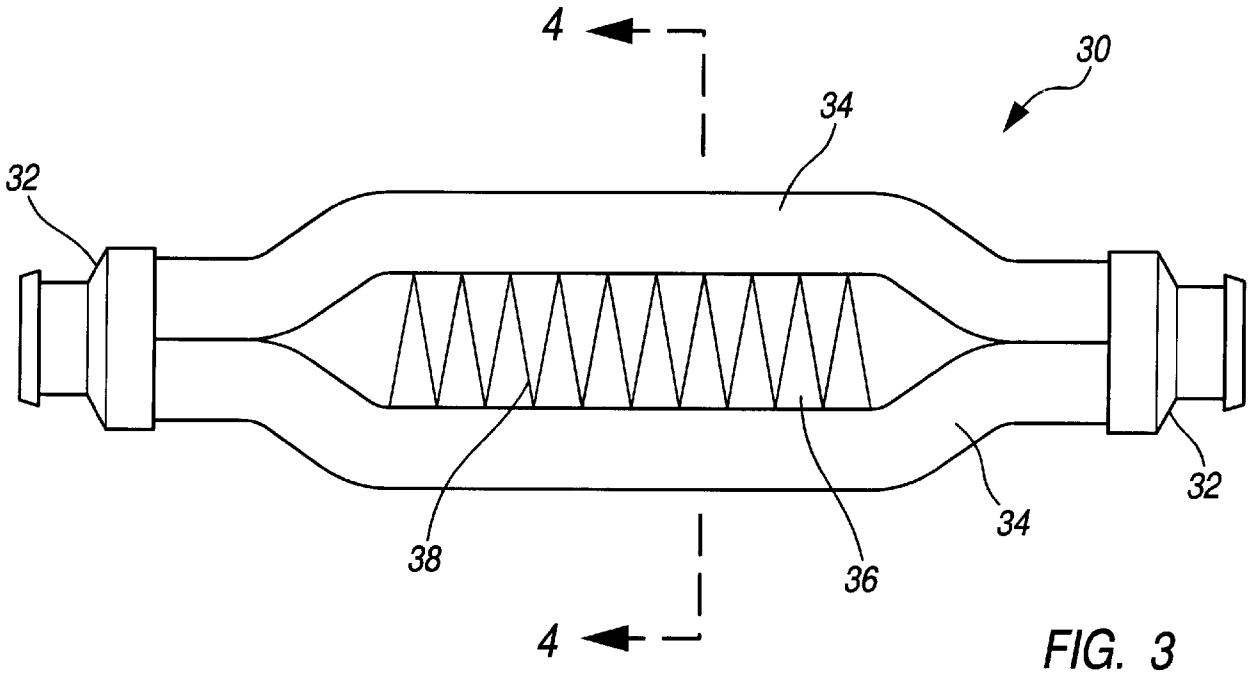
FIG. 3 is a side view of a heat exchanger constructed in accordance with the principles of the invention.

Turning now to FIGS. 3 and 4, a heat exchanger constructed in accordance with the invention is designated 30. The principal components of the heat exchanger 30 include end fittings 32 which may be machined or die cast from aluminum or other suitable metallic materials. Connected to the end fittings 32 are a pair of tubes 34 which are preferably formed with a half-round or semi-circular cross section and are made from a suitable metal such as aluminum or copper.

As the tubes 34 exit the fittings 32 they diverge away from one another and run in parallel spaced relation to one another at their central portions creating an opening 36 between them. Inserted in the opening 36 and secured to the tubes 34 as by welding or brazing is a serpentine metallic fin 38 for purposes of enhancing heat dissipation.

Figure 5:
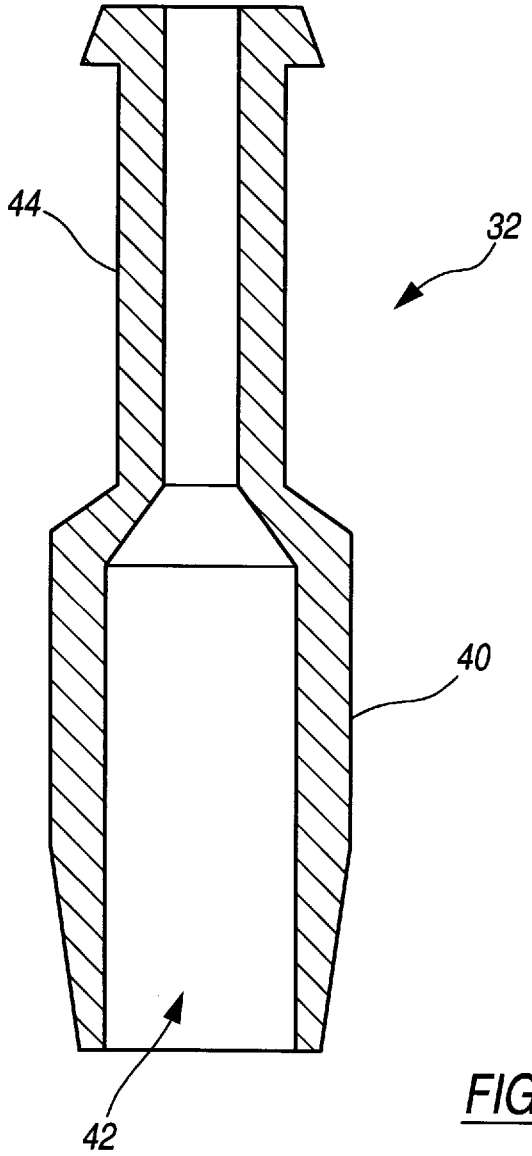
FIG. 5 is a cross-sectional view of a fitting as used in the heat exchanger of FIG. 3.
Figure 6:
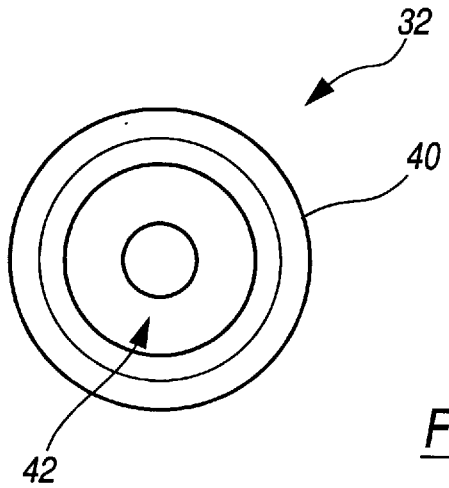
FIG. 6 is an end view of the fitting of FIG. 5.

The details of the fittings 32 may best be seen in FIGS. 5 and 6. The fittings 32 are substantially identical and include a body portion 40 having a central round bore 42 for receiving ends of both half-round tubes 34. A necked down portion 44 of the fitting serves to provide connection to inlet and outlet hoses which may be clamped thereto.

Figure 8:
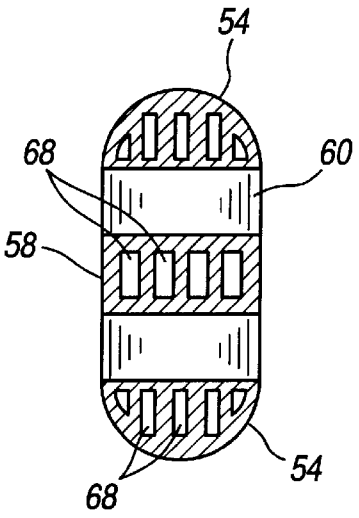
FIG. 8 is a cross-sectional view taken substantially along the line 8—8 of FIG. 7.
Figure 7:
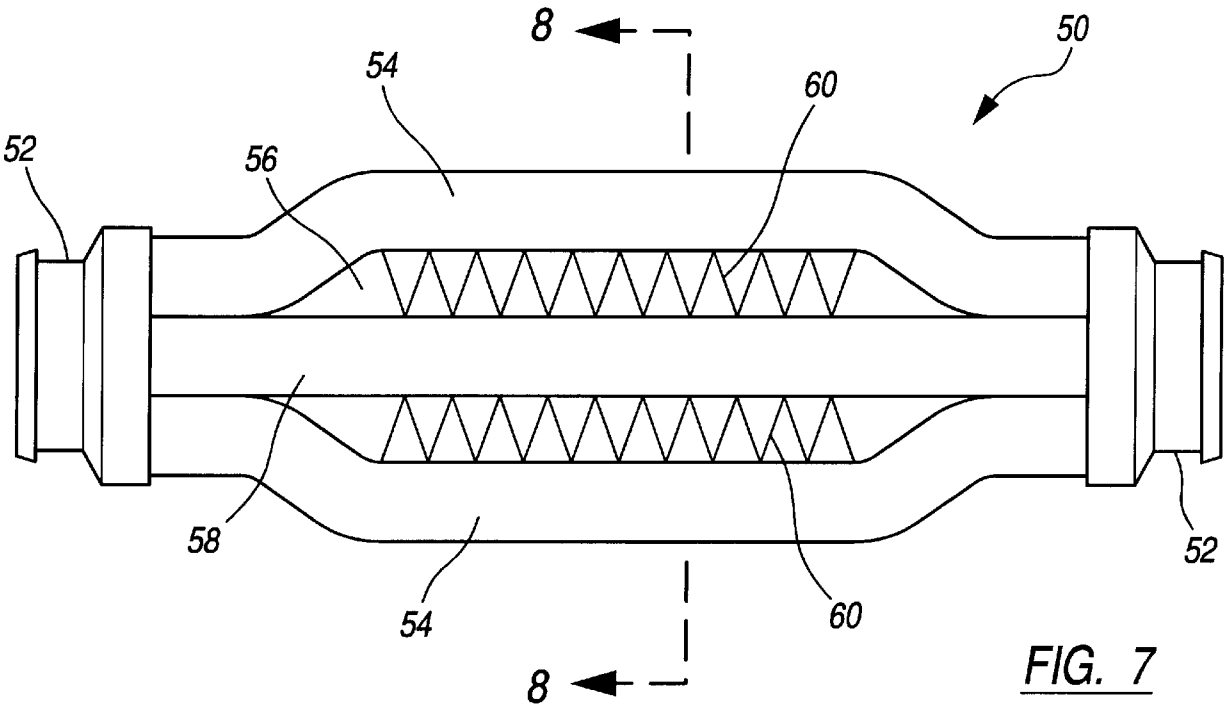
FIG. 7 is a side view of a second embodiment of a heat exchanger constructed according to the invention.

Referring now to FIGS. 7 and 8, a second embodiment of a heat exchanger constructed according to the invention is designated 50. This heat exchanger 50 is constructed with end fittings 52 having a pair of half-round tubes 54 connected between the fittings 52. As in the heat exchanger 30, the tubes 54 diverge away from each other as they exit the fittings 52 then run parallel to one another with a space 56 between them. However, disposed within the space 56 is a third tube 58 positioned centrally of the tubes 54. Unlike the tubes 54, the third tube 58 is substantially rectangular in cross-section and thus is formed to essentially sandwich at its ends between the half-round tubes 54. Suitable fins 60 may be secured between the tubes 54 and 58 for enhancement of heat transfer.

Figure 9:
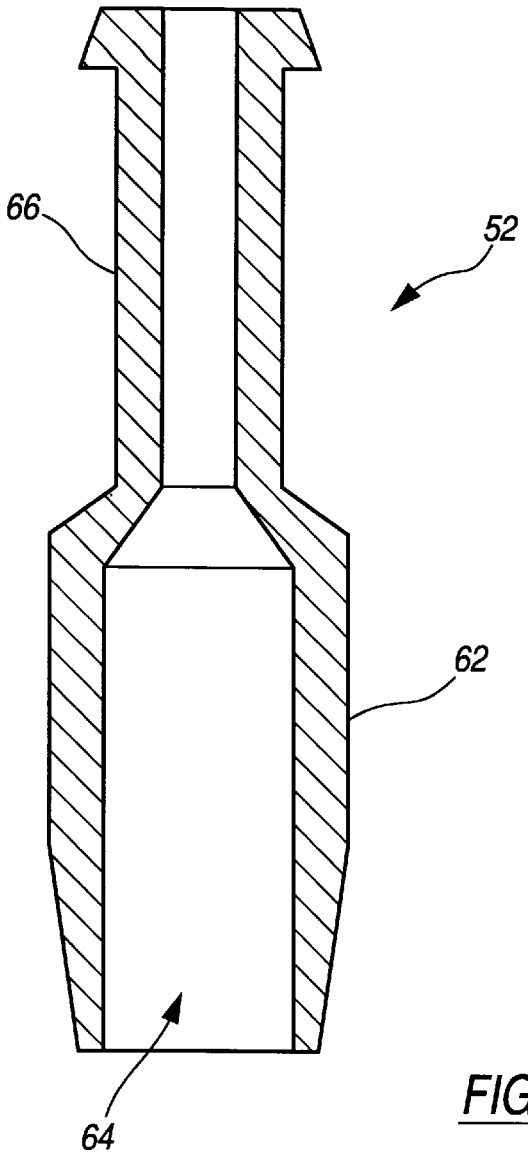
FIG. 9 is a cross-sectional view of a fitting as used in the heat exchanger of FIG. 7.
Figure 10:
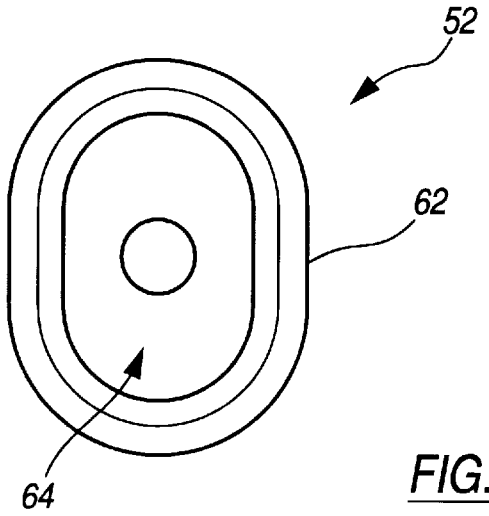
FIG. 10 is an end view of the fitting of FIG. 9.
Figure 11A:
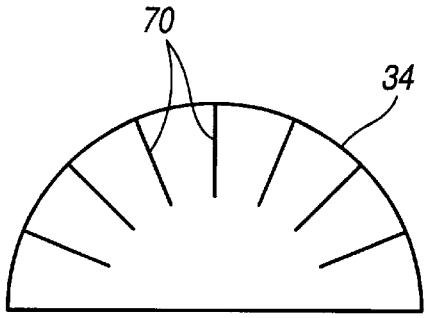
FIGS. 11A through 11E represent alternative cross-sections for the tubes used in the heat exchanger of the present invention.
Figure 11B:
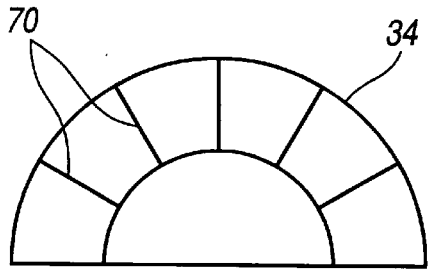
Figure 11C:
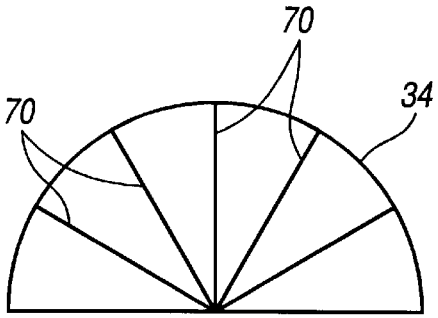
Figure 11D:
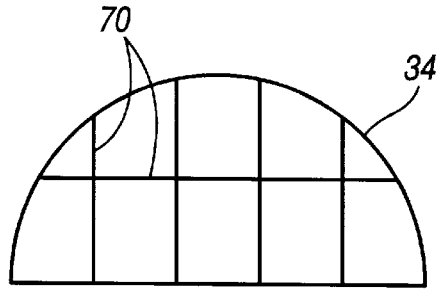
Figure 11E:
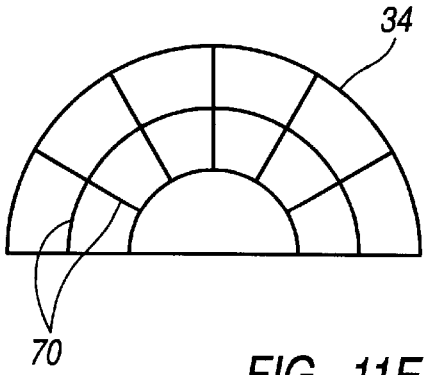

The details of the fittings 52 used in construction of the heat exchanger 50 may best be seen in FIGS. 9 and 10. Like the fittings 32, these fittings 52 have a body portion 62 with a central bore 64 and a necked-down portion 66 for connection to a suitable hose (not shown). However, the bore 64 is generally oval in cross-section, such that the ends of the tubes 54 and 58 all fit snugly therein and can be brazed or welded to the fitting 52.

As seen in FIGS. 4 and 8, the tubes 34, 54, and 58 may all be formed, as by extruding, with internal walls 68 which serve to enhance heat transfer from the fluid flowing within them. In addition, it will be appreciated that numerous constructions of internal tube walls may be provided. For example, shown schematically in FIGS. 11A through 11E are half-round tubes 34 with various geometric formations of fins 70, all of which can be extruded as to provide enhanced heat transfer characteristics.

It can now be appreciated that the heat exchangers 30 and 50 of the present invention offer considerable advantages in construction over prior art heat exchangers of a type using header tanks, for example. The use of simple metal fittings 32 and 52 permits the heat exchangers 30 and 50, respectively, to be constructed without complicated header tank forming processes which involve separate cleaning methods. The forming of precise slots in the headers to receive multiple flat tubes is completely avoided. Moreover, the fittings 32 and 52 can be seen to be capable of withstanding significantly greater internal pressure and thus can be fabricated with lighter weight as compared to header tanks of common design. Thus, higher pressure applications are possible for the heat exchangers 30 and 50 than for known prior art heat exchangers. Although only a two tube heat exchanger 30 and three tube heat exchanger 50 have been illustrated herein, it can be appreciated that essentially any number of tubes may be provided with appropriate construction and sizing of the bore 64 of the fitting 52. Further, it will be appreciated that the use of half-round tubes 54 and rectangular center tubes 58 of the heat exchangers makes it possible to weld or braze heat dissipating fins 60 directly to the flat sides of the tubes 54 and 58 without specially fin fabricating construction. Thus, economics are realized in the manufacture of the heat exchangers 30 and 50.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A heat exchanger comprising:

a pair of spaced fittings each fitting have a first opening on a first side thereof for communication with a fluid carrying conduit;

at least a pair of first tubes having opposed ends connected to second sides of said fittings and in fluid communication with said first openings, said first tubes being generally semi-circular in cross-section;

a third tube connected to said second sides of said fittings, said third tube being generally rectangular in cross-section and being disposed between said first tubes;

said fittings being provided with second openings through said second sides thereof said second openings being generally oval in cross-section for receiving said first and third tubes; and said first tubes diverging away from one another as they extend from said fittings.

2. The heat exchanger of claim 1 wherein said tubes are each provided with heat dissipating fins.

3. The heat exchanger of claim 1 wherein heat dissipating fins are secured to flat sides of said tubes.

4. The heat exchanger of claim 1 wherein heat dissipating fins are connected between said third tube and said first tubes.

* * * * *